US009631461B2

(12) United States Patent
Lopez et al.

(10) Patent No.: US 9,631,461 B2
(45) Date of Patent: Apr. 25, 2017

(54) WELL FLOW CONTROL WITH MULTI-STAGE RESTRICTION

(71) Applicant: Halliburton Energy Services, Inc., Houston, TX (US)

(72) Inventors: Jean-Marc Lopez, Plano, TX (US); Luke William Holderman, Plano, TX (US); Stephen Michael Greci, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 333 days.

(21) Appl. No.: 13/768,431

(22) Filed: Feb. 15, 2013

(65) Prior Publication Data

US 2013/0213667 A1 Aug. 22, 2013

(51) Int. Cl.

| | |
|---|---|
| ***E21B 43/12*** | (2006.01) |
| ***E21B 43/08*** | (2006.01) |
| *E21B 34/06* | (2006.01) |

(52) U.S. Cl.

CPC ..... *E21B 43/12* (2013.01); *E21B 43/086* (2013.01); *E21B 34/06* (2013.01)

(58) Field of Classification Search

CPC ..... E21B 43/08; E21B 43/12; E21B 43/32
See application file for complete search history.

(56) References Cited

U.S. PATENT DOCUMENTS

| | | | |
|---|---|---|---|
| 6,015,011 | A | 1/2000 | Hunter |
| 6,220,345 | B1 | 4/2001 | Jones et al. |
| 6,622,794 | B2 | 9/2003 | Zisk, Jr. |
| 7,426,962 | B2 | 9/2008 | Moen et al. |
| 7,469,743 | B2 | 12/2008 | Richards |

(Continued)

FOREIGN PATENT DOCUMENTS

| | | |
|---|---|---|
| CN | 1375036 A | 10/2002 |
| CN | 101903603 | 12/2010 |

OTHER PUBLICATIONS

Authorized officer Kwak Joong Hwan, International Search Report and Written Opinion in International Application No. PCT/US2012/025576, mailed Oct. 25, 2012, 12 pages.
Halliburton, "EquiFlow® Systems" Copyright 2009 (18 pages).
Saudi Arabia Oil & Gas, Issue 7, 2008 (104 pages).
Hans-Emil Bensnes Torbergsen, Master's Thesis, University of Stavanger, Oct. 12, 2010 (557 pages).
Invitation to Respond to Written Opinion, Singapore Intellectual Property Office, Singapore Application No. 11201404435Y, Nov. 25, 2015, 7 pages.

(Continued)

*Primary Examiner* — Giovanna C Wright
*Assistant Examiner* — Tara Schimpf
(74) *Attorney, Agent, or Firm* — Scott Richardson; Parker Justiss, P.C.

(57) ABSTRACT

A well screen assembly includes a tubular base pipe. The base pipe has a sidewall aperture that communicates fluid between an interior central bore of the base pipe and an exterior of the base pipe. A filtration screen is around the base pipe. The filtration screen defines a lateral fluid passage along a axial length of the well screen assembly. A flow control device is coupled to the base pipe and the filtration screen. The flow control devices includes a ring sealing the lateral fluid passage from the central bore. An elongate restrictor passage is in the ring, oriented longitudinally. The elongate restrictor passage is configured to communicate fluid between the lateral fluid passage and the central bore. The restrictor passage includes an internal, square edged orifice defined by a fixed, annular protrusion. The annular protrusion extends inwardly from an interior surface of the restrictor passage.

21 Claims, 3 Drawing Sheets

(56) References Cited

U.S. PATENT DOCUMENTS

| | | | | |
|---|---|---|---|---|
| 7,775,284 | B2 * | 8/2010 | Richards et al. | 166/329 |
| 7,814,973 | B2 | 10/2010 | Dusterhoft et al. | |
| 8,474,535 | B2 | 7/2013 | Richards et al. | |
| 2006/0048942 | A1 * | 3/2006 | Moen et al. | 166/306 |
| 2007/0246407 | A1 * | 10/2007 | Richards et al. | 210/97 |
| 2009/0000787 | A1 | 1/2009 | Hill et al. | |
| 2009/0084556 | A1 | 4/2009 | Richards et al. | |
| 2010/0051262 | A1 | 3/2010 | Dusterhoft et al. | |
| 2010/0252250 | A1 | 10/2010 | Fripp et al. | |
| 2011/0011586 | A1 | 1/2011 | Dusterhoft et al. | |
| 2011/0036567 | A1 | 2/2011 | Holderman et al. | |
| 2011/0056677 | A1 | 3/2011 | Holderman | |
| 2011/0083860 | A1 | 4/2011 | Gano et al. | |
| 2011/0247833 | A1 | 10/2011 | Todd et al. | |
| 2011/0253391 | A1 | 10/2011 | Veit et al. | |

OTHER PUBLICATIONS

Canadian Requisition by Examiner, Canadian Application No. 2,862,111, Jul. 8, 2015, 2 pages.

First Office Action issued in Chinese Application No. 201280069524.5 by the The State Intellectual Property Office of the People's Republic of China, dated Mar. 29, 2016.

Canadian Office Action issued in Application No. 2,862,111 by the Canadian Intellectual Property Office, dated Apr. 1, 2016.

Extended European Search Report issued in European Application No. 12868727.4 by the European Patent Office, dated Mar. 15, 2016.

* cited by examiner

WELL FLOW CONTROL WITH MULTI-STAGE RESTRICTION

BACKGROUND

It is often desirable to control fluid flow into or out of the completion string of a well system, for example, to balance inflow or outflow of fluids along the length of the well. For instance, some horizontal wells have issues with the heel-toe effect, where gas or water cones in the heel of the well and causes a difference in fluid influx along the length of the well. The differences in fluid influx can lead to premature gas or water break through, significantly reducing the production from the reservoir. Inflow control devices (ICD) can be positioned in the completion string at heel of the well to stimulate inflow at the toe and balance fluid inflow along the length of the well. In another example, different zones of the formation accessed by the well can produce at different rates. ICDs can be placed in the completion string to reduce production from high producing zones, and thus stimulate production from low or non-producing zones. In injecting fluids into the zone, for example, flow control devices can be used to supply a more uniform flow of injection fluid or specified different flows of fluid to different zones of the formation. There are yet other applications of flow control devices.

SUMMARY

The concepts described herein encompass a well screen assembly including a tubular base pipe. The base pipe has a sidewall aperture that communicates fluid between an interior central bore of the base pipe and an exterior of the base pipe. A filtration screen is around the base pipe. The filtration screen defines a lateral fluid passage along a axial length of the well screen assembly. A flow control device is coupled to the base pipe and the filtration screen. The flow control devices includes a ring sealing the lateral fluid passage from the central bore. An elongate restrictor passage is in the ring, oriented longitudinally. The elongate restrictor passage is configured to communicate fluid between the lateral fluid passage and the central bore. The restrictor passage includes an internal, square edged orifice defined by a fixed, annular protrusion. The annular protrusion extends inwardly from an interior surface of the restrictor passage.

The concepts herein encompass a well device including a tubing having a sidewall aperture through to the central bore of the tubing. A flow control housing is carried on the tubing and defines an annular chamber over the aperture. A flow control ring seals a first portion of the annular chamber in fluid communication with the aperture from a second portion of the annular chamber. An orifice tube extends longitudinally through the flow control ring, and communicates the first and second portions of the annular chamber. The orifice tube includes an internal, square edged orifice defined by a fixed, annular protrusion extending inwardly from an interior surface of the orifice tube.

The concepts herein encompass a method of controlling flow in a well. In the method flow between an interior central bore of a tubular base pipe and a filtration screen about the base pipe is received in a flow control device. The flow is restricted by an elongate restrictor passage oriented longitudinally. The restrictor passage comprises an internal, square edged orifice defined by a fixed, annular protrusion extending inwardly from an interior surface of the restrictor passage.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
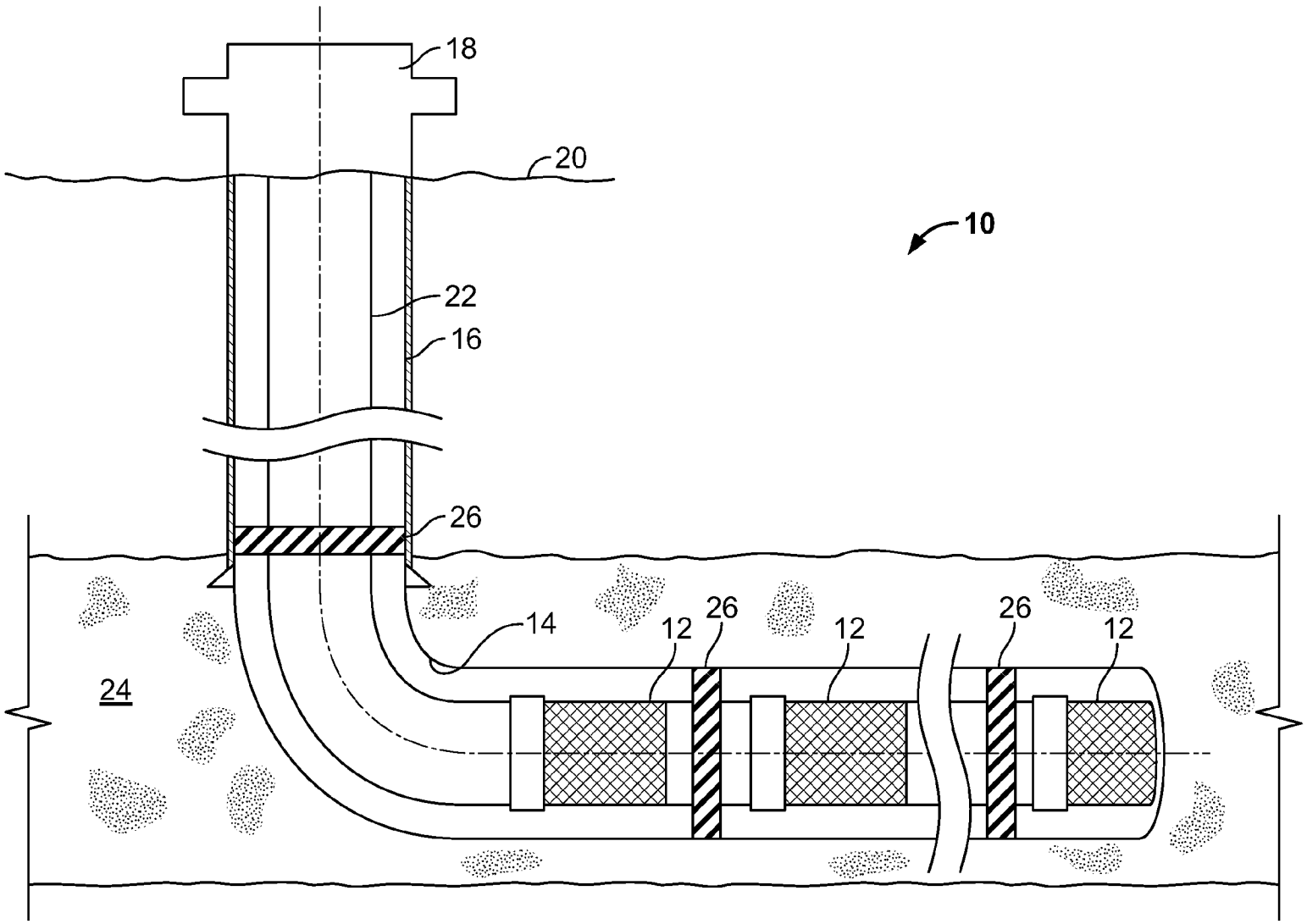
FIG. 1 is a side cross-sectional view of an example well system including a plurality of well screen assemblies.

FIG. 1 illustrates an example well system 10 including a plurality of well screen assemblies 12. The well system 10 is shown as being a horizontal well, having a wellbore 14 that deviates to horizontal or substantially horizontal in the subterranean zone of interest 24. A casing 16 is cemented in the vertical portion of the wellbore and coupled to a wellhead 18 at the surface 20. The remainder of the wellbore 14 is completed open hole (i.e., without casing). A production string 22 extends from wellhead 18, through the wellbore 14 and into the subterranean zone of interest 24. A production packer 26 seals the annulus between the production string 22 and the casing 16. Additional packers 26 can be provided between the screen assemblies 12. The production string 22 operates in producing fluids (e.g., oil, gas, and/or other fluids) from the subterranean zone 24 to the surface 20. The production string 22 includes one or more well screen assemblies 12 (three shown). In some instances, the annulus between the production string 22 and the open hole portion of the wellbore 14 may be packed with gravel and/or sand. The well screen assemblies 12 and gravel/sand packing allow communication of fluids between the production string 22 and subterranean zone 24. The gravel/sand packing provides a first stage of filtration against passage of particulate and larger fragments of the formation to the production string 22. The well screen assemblies 12 provide a second stage of filtration, and are configured to filter against passage of particulate of a specified size and larger into the production string 22.

Although shown in the context of a horizontal well system 10, the concepts herein can be applied to other well configurations, including vertical well systems consisting of a vertical or substantial vertical wellbore, multi-lateral well systems having multiple wellbores deviating from a common wellbore and/or other well systems. Also, although described in a production context, concepts herein can are applicable in other contexts, including injection (e.g., with the well screen assembly 12 as part of an injection string), well treatment (e.g., with the well screen assembly 12 as part of a treatment string) and/or other applications.

Figure 2:
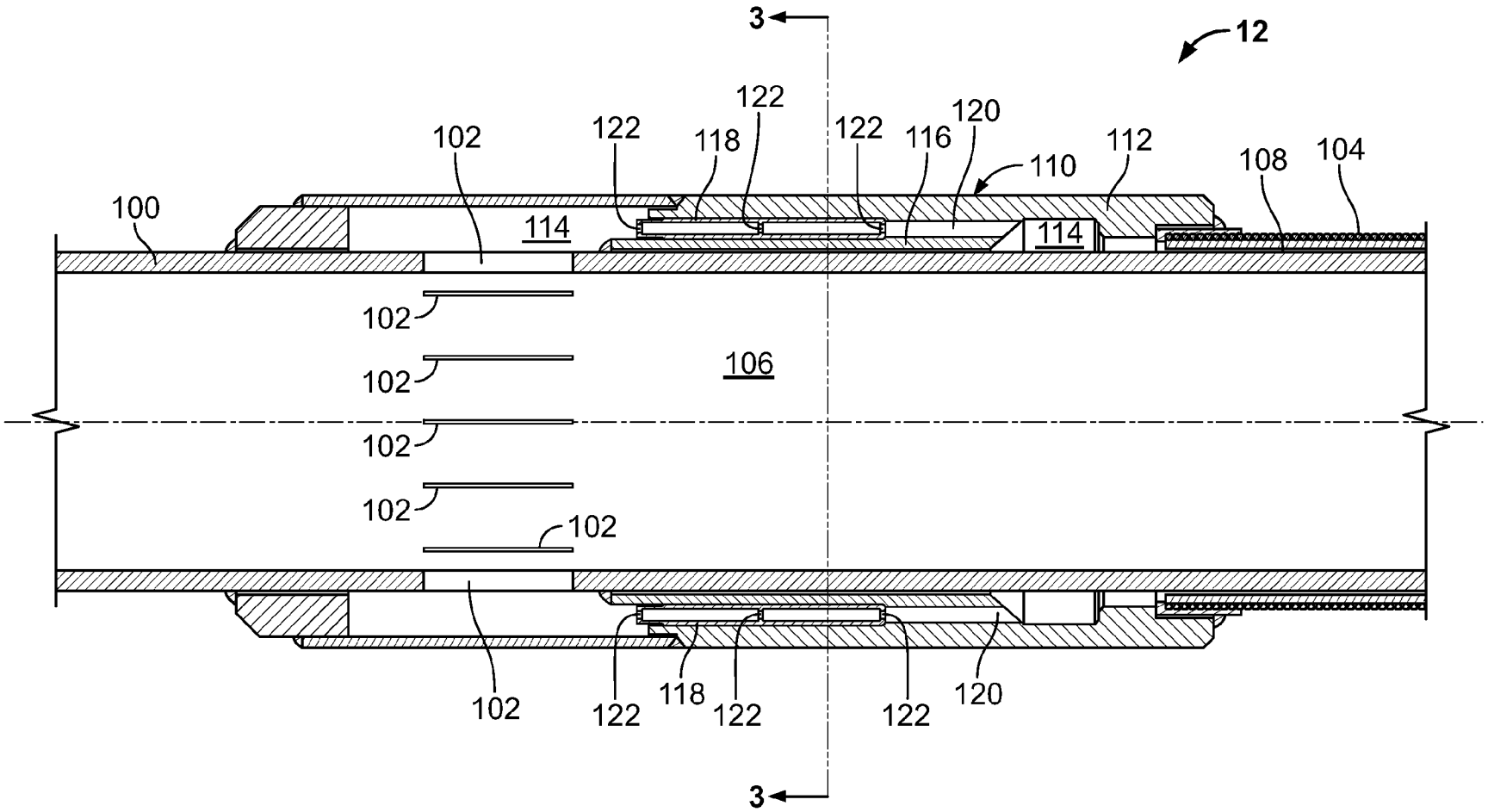
FIG. 2 is a side cross-sectional view of an example well screen assembly with a flow control device.

As seen in FIG. 2, the example well screen assembly 12 includes an apertured base pipe 100 (with square, round, slotted and/or other shaped apertures 102 in the sidewall) that carries a filtration screen assembly 104. The ends of the base pipe 100 are configured to couple (e.g., threadingly and/or otherwise) to other components of the completion string. The apertures communicate fluid between an interior central bore 106 of the base pipe 100 and an exterior of the base pipe. A flow control device 110 is positioned circumferentially about the base pipe 100. The filtration screen assembly 104 is positioned circumferentially about intermediate portion of the base pipe 100, sealed at one end to the base pipe 100 and sealed to the flow control device 110 at its other end. Therefore, flow between the filtration screen assembly 104 and the central bore 106 of the base pipe 100 must flow through the flow control device 110. The flow control device 110 operates as a flow restriction of specified characteristics to control the flow between central bore 106 and the exterior of the well screen assembly 12 and surrounding well bore annulus and subterranean zone. In certain instances, one or more other flow control devices 110 can be positioned on the base pipe 100, for example, at the opposing end of the screen assembly 104 and/or intermediate the ends of the screen assembly 104. In instances where more than one flow control device 110 are provided on the base pipe 100, the screen assembly 104 is sealed at both ends to a flow control device 110.

The screen assembly 104 is a filter that filters against passage of particulate of a specified size larger. Screen assembly 104 can take a number of different forms and can have one or multiple layers. Some example layers include a preformed woven and/or nonwoven mesh, wire wrapped screen (e.g., a continuous helically wrapped wire), apertured tubing, and/or other types of layers. Screen assembly 104 defines lateral fluid passages 108 interior to the screen assembly 104 and/or between the screen assembly 104 and the base pipe 100. The lateral fluid passages 108 communicate fluid axially along the length of the flow control device 110.

The flow control device 110 includes an outer housing 112 affixed and sealed to the base pipe 100 at one end and affixed and sealed to the screen assembly 104 at the opposing end. The housing 112 defines an annular chamber 114 in communication with the lateral passages 108 of the screen assembly 104 and the central bore 106 via the apertures 102. The housing 112 has a flow restrictor ring 116 between the apertures 102 and the screen assembly 104. The flow restrictor ring 116 is sealed to the exterior of the base pipe 100, for example, by welding, by mechanical seals, and/or in another manner, to seal the apertures 102 from the lateral passages 108 of the screen assembly 104. All flow between the apertures 102 and the lateral fluid passages 108 must flow through a plurality of elongate restrictor tubes 118 carried by the flow restrictor ring 116. Although shown as an integral part of the housing 112, in other instances, the flow restrictor ring 116 can be a separate piece that is also sealed to the interior of the housing 112.

The restrictor tubes 118 have a plurality of internal flow orifices 122 configured to cause a specified flow rate drop and/or pressure drop in flow through the tubes. The plurality of orifices 122 provide a multistage flow restriction. The restrictor tubes 118 are affixed in the restrictor ring 116, for example, removably with threads on the exterior of the restrictor tubes 118 that mate with corresponding threads in a bore 120 in the restrictor ring 116. In other instances, the restrictor tubes can be clamped between mating components of the restrictor ring 116, bonded (e.g., by welding, brazing, adhesive, and/or other bond) and/or otherwise removably or permanently attached. As seen in FIG. 2, the flow path through the restrictor tubes 118 is straight and oriented longitudinally in the housing 112, parallel (precisely or substantially parallel) to the longitudinal axis of the base pipe 100. Likewise, because the tubes 118 are straight, they are also oriented longitudinally in the housing 112. Other orientations are within the concepts described herein. One end of the restrictor tubes 118 is near the filtration screen assembly 104 and the other is near the apertures 102. In the configuration of FIG. 2, there is nothing between the end of the restrictor tubes 118 and the outlet of the lateral passages 108, nor is there anything between the end of the restrictor tubes 118 and the apertures 102. Thus, the restrictor tubes 118 are the primary restriction to flow through the flow control device 110.

Figure 3:
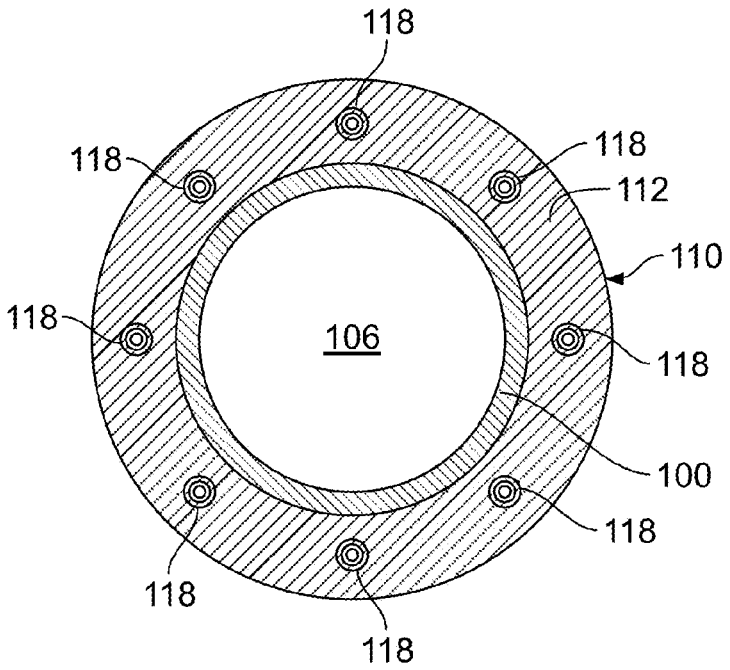
FIG. 3 is an axial cross-sectional view taken along 3-3 of FIG. 2 illustrating an example well screen assembly having a support ring integral to the housing.

As seen in FIG. 3, an axial cross section of the flow control device 110, if more than one restrictor tube 118 is provided, they can be spaced azimuthally apart in an array around the circumference of the base pipe 100. FIG. 3 shows the restrictor tubes 118 being equally azimuthally spaced apart (i.e., the azimuth between each restrictor tube 118 is equal), but in other instances, they can be otherwise irregularly or regularly spaced.

The restrictor tubes 118 each have one or more internal square edged, orifices 122 configured to cause a specified drop in flow rate through the tubes. Each orifice 122 is defined by a fixed, annular protrusion protruding inwardly from an interior surface of the restrictor tube 118. The flow area through the orifices 122 is the most restrictive flow area through the restrictor tube 118, and in certain instances, through the entire flow control device 110. The remainder of the restrictor tube 118 is of a substantially uniform largest transverse dimension. In FIG. 3, the restrictor tubes 118 are shown as cylindrical (i.e., with a round inner cross-section), so in the provided example, the largest transverse dimension is the inner diameter. However, in other instances, the tubes 118 can be other shapes.

Figure 4:
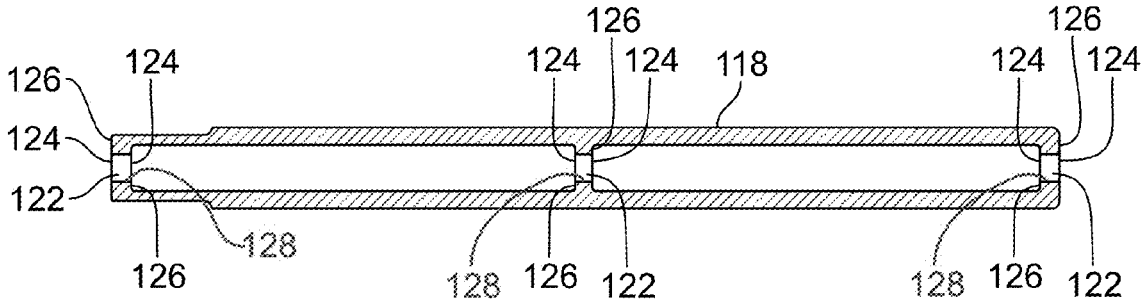
FIG. 4 is a side cross-sectional view of a restrictor tube.

The orifices 122 are configured to provide a flow rate drop that has a greater independence to fluid viscosity than other common flow restriction shapes. For example, orifice 122 is square edged in that at least one of the orifice's openings 124, and in FIG. 2 both its opening 124 toward the filtration screen assembly 104 and its opening 124 toward the apertures 102, have edges defined by surfaces meeting at right angles (precisely or substantially right angles). In certain instances, one or both of the edges can be provided without a fillet or chamfer added to the edge and can even be manufactured to be sharp. The annular protrusion that defines the orifice 122 can have a square shoulder 126 (FIG. 4) spanning the opening 124 and the internal wall of the restrictor tube 118. The shoulder 126 is orthogonal (precisely or substantially orthogonal) to the longitudinal axis of the restrictor tube 118. Although FIG. 2 shows the square shoulder 126 provided on both the side toward the filtration screen assembly 104 and the side toward the apertures 102, the square shoulder 126 can be provided on only one side of the orifice 122. The inner sidewall surface 128 of the orifices 122, extending from shoulder 126 to shoulder 126 (i.e., edge to edge), is shown cylindrical and parallel to the longitudinal axis of the restrictor tube 118, but can be other configurations. Additionally, the annular protrusion that defines the orifice 122 is short. For example, the length of annular protrusion along the longitudinal axis of the restrictor tube 118 can be less the largest transverse inner dimension of the tube 118 and/or orifice 122 (e.g., diameter, if is cylindrical). In certain instances, the axial length of the annular protrusion is approximately equal to or less than half the largest transverse inner dimension of the orifice 122. In certain instances, the axial length of the annular protrusion is less than half, and in some instances less than one third, the largest transverse inner dimension of the tube 118. Finally, the flow reduction is achieved with multiple orifices 122, rather than a single orifice.

The configuration FIG. 2 shows three orifices 122 in each restrictor tube 118. In other instances, some or all of the restrictor tubes 118 can have a different number of flow orifices 122. In certain instances, some or all of the restrictor tubes 118 can be provided without internal orifices 122. The orifices 122 of a given tube 118 can be of the same or different configuration. For example, all can have the same flow area and/or the same maximum transverse dimension (e.g., diameter, if the orifices are cylindrical) or some can have different flow areas and/or maximum transverse dimensions. All can have the same axial length or some can have different axial lengths. All can have the same configuration of square/not-square edges and/or shoulders and some can have different configurations of edges and/or shoulders.

The configuration of the restrictor tubes 118 and/or mix of different configurations of restrictor tubes 118 can be tailored to achieve specified flow properties, such as pressure drop and/or flow rate drop, through the flow control device. Further, having removably attached restrictor tubes 118 allows interchanging the restrictor tubes 118 to initially configure and reconfigure a previously configured flow control device 110 to set or change the flow properties. Additionally, some or all of the different configurations of restrictor tubes 118 can be configured to fit in some or all of the different configurations of flow restrictor housing 112 and ring 116. Thus, for example, one can manufacture and stock a broad array of different lengths, inner diameters, number and configuration of restrictor tubes 118. A smaller number of flow restrictor housings 112 and rings 116 and/or partially assembled flow control devices 110 lacking the restrictor tubes 118 can then be manufactured and/or stocked, for example, corresponding to each size of base pipe 100. Then, when one or more flow control devices 110 are needed for a well, the appropriate restrictor tubes 118 to achieve specified flow properties for the particular well can be added. Such modularity can save on manufacturing and inventory expense.

A number of embodiments have been described. Nevertheless, it will be understood that various modifications may be made. Accordingly, other embodiments are within the scope of the following claims.

What is claimed is:

1. A well screen assembly, comprising:

a tubular base pipe comprising a sidewall aperture that communicates fluid between an interior central bore of the base pipe and an exterior of the base pipe;

a filtration screen around the base pipe, the filtration screen defining a lateral fluid passage along an axial length of the well screen assembly; and a flow control device coupled to the base pipe and the filtration screen, the flow control device comprising a ring sealing the lateral fluid passage from the central bore and a plurality of elongate restrictor passages in the ring, each of the plurality of restrictor passages oriented longitudinally relative to the base pipe, residing azimuthally spaced apart from each other in an array around the circumference of the base pipe, and configured to communicate fluid between the lateral fluid passage and the central bore, each of the plurality of restrictor passages comprising a single-piece contiguous tubular structure independent of the base pipe, filtration screen and ring, and traversing the complete length of the respective restrictor passage and having a plurality of internal, square edged orifices each orifice defined by a fixed, each annular protrusion extending inwardly from an interior surface of the tubular structure, with at least one of the plurality of orifices located between opposing ends of the tubular structure.

2. The well screen assembly of claim 1, where each of the plurality of orifices is square edged on both a first opening and an opposing opening.

3. The well screen assembly of claim 1, where each annular protrusion comprises a square shoulder that is orthogonal to the longitudinal axis of each of the associated restrictor passages.

4. The well screen assembly of claim 3, where each annular protrusion comprises a second square shoulder opposite the first mentioned shoulder, the second shoulder is orthogonal to the longitudinal axis of each of the associated restrictor passages.

5. The well screen assembly of claim 4, where each annular protrusion comprises an inner sidewall surface extending from the first mentioned shoulder to the second shoulder, and the inner sidewall surface is parallel to the longitudinal axis of each of the associated restrictor passages.

6. The well screen assembly of claim 5, where the inner sidewall surface of each of the associated restrictor passages meets the first mentioned shoulder at a right angle, without a fillet or chamfer.

7. The well screen assembly of claim 4, where each annular protrusion comprises a cylindrical inner sidewall surface extending from the first mentioned shoulder to the second shoulder.

8. The well screen assembly of claim 1, where the flow area through each of the plurality of orifices is the most restrictive flow area through the flow control device.

9. The well screen assembly of claim 1, where each of the plurality of orifices are equally spaced along the longitudinal length of each of the associated restrictor passages.

10. The well screen assembly of claim 1, where the flow area of at least one of the plurality of orifices is different than the flow area of another of the plurality of orifices.

11. The well screen assembly of claim 1, where the length of each annular protrusion along the longitudinal axis of each of the associated restrictor passages is less than half the largest transverse inner dimension of each of the associated restrictor passages.

12. The well screen assembly of claim 1, where the length of each annular protrusion along the longitudinal axis of each of the associated restrictor passages is less than the largest transverse inner dimension of each annular protrusion.

13. The well screen assembly of claim 1, where each of the associated restrictor passages is an internal bore of the tubular structure that is threadingly secured in the ring.

14. The well screen assembly of claim 1, where each of the associated restrictor passages extends between a location proximate the lateral fluid passage of the screen and a location proximate the sidewall aperture of the base pipe.

15. The well screen assembly of claim 1, where each of the associated restrictor passages apart from each associated annular protrusion has a substantially uniform transverse dimension.

16. A well device, comprising:

a tubing having a sidewall aperture through to a central bore of the tubing;

a flow control housing carried on the tubing and defining an annular chamber over the aperture;

a flow control ring sealing a first portion of the annular chamber in fluid communication with the aperture from a second portion of the annular chamber; and a plurality of contiguous single-piece orifice tubes extending longitudinally through the flow control ring, each of the plurality of orifice tubes azimuthally spaced apart from each other in an array around the circumference of the tubing and communicating the first and second portions of the annular chamber, each of the plurality of orifice tubes independent of the tubing, the flow control housing, and the flow control ring, and comprising a plurality of internal, square edged orifices each defined by a fixed, annular protrusion extending inwardly from an interior surface of each of the plurality of orifice tubes, with at least one of the plurality of orifices located between opposing ends of the respective orifice tube.

17. The well device of claim 16, where each of the plurality of orifice tubes apart from each of the associated annular protrusions has a substantially uniform transverse dimension.

18. The well device of claim 17, where the length of each annular protrusion along the longitudinal axis of each of the plurality of orifice tubes is less than half the largest transverse inner dimension of each of the plurality of orifice tubes.

19. The well device of claim 16, where each annular protrusion comprises:

a first square shoulder that is orthogonal to the longitudinal axis of each of the associated orifice tube;

a second square shoulder opposite the first shoulder that is orthogonal to the longitudinal axis of each of the associated orifice tube; and a cylindrical inner sidewall surface that is parallel to the longitudinal axis of each of the associated orifice tube and extends from the first shoulder to the second shoulder, and where the inner sidewall surface meets at least the first mentioned shoulder at a right angle, without a fillet or chamfer.

20. The well device of claim 16, where each of the plurality of orifices is square edged on both a first opening and an opposing opening.

21. A method of controlling flow in a well, the method comprising:

receiving, in a flow control device, flow between an interior central bore of a tubular base pipe and a filtration screen about the base pipe; and restricting the flow with a plurality of elongate restrictor passages oriented longitudinally relative to the base pipe, residing azimuthally spaced apart from each other in an array around the circumference of the base pipe, and each comprising a single-piece contiguous tubular structure independent of the base pipe and the filtration screen, and traversing the complete length of each of the respective restrictor passage and having a plurality of internal, square edged orifices each defined by a fixed, annular protrusion extending inwardly from an interior surface of the tubular structure, with at least one of the plurality of orifices located between opposing ends of the tubular structure.

* * * * *